US008985907B2

(12) United States Patent
Okobi

(10) Patent No.: US 8,985,907 B2
(45) Date of Patent: Mar. 24, 2015

(54) MOUNTABLE EARTH-EMBEDDING ANCHOR WITH REMOVABLE UNDERGROUND CONDUIT PANELS AND INSTALLATION APPARATUS

(71) Applicant: Anthony Obiesie Okobi, Durham, NC (US)

(72) Inventor: Anthony Obiesie Okobi, Durham, NC (US)

( * ) Notice: Subject to any disclaimer, the term of this patent is extended or adjusted under 35 U.S.C. 154(b) by 130 days.

(21) Appl. No.: 13/651,767

(22) Filed: Oct. 15, 2012

(65) Prior Publication Data

US 2013/0108374 A1 May 2, 2013

Related U.S. Application Data

(60) Provisional application No. 61/551,435, filed on Oct. 26, 2011.

(51) Int. Cl.
*E02D 5/80* (2006.01)
*E21D 20/00* (2006.01)
*E04H 12/22* (2006.01)

(52) U.S. Cl.
CPC ..... *E04H 12/2223* (2013.01); *E04H 12/2269* (2013.01); *E04H 12/2253* (2013.01)
USPC ..... 405/184.4; 405/252.1; 52/157

(58) Field of Classification Search
USPC ..... 405/259.1, 184.4, 154.1, 252.1; 52/155, 52/157
See application file for complete search history.

(56) References Cited

U.S. PATENT DOCUMENTS

| | | | | |
|---|---|---|---|---|
| 4,009,545 | A * | 3/1977 | Rossborough | 408/88 |
| 2006/0060730 | A1 | 3/2006 | Walker | |
| 2010/0036316 | A1 * | 2/2010 | Agrawal | 604/110 |
| 2010/0319272 | A1 * | 12/2010 | Kellner | 52/157 |

FOREIGN PATENT DOCUMENTS

GB 2424906 A 10/2006

OTHER PUBLICATIONS

International Preliminary Report on Patentability issued Apr. 29, 2014 for PCT/US2012/060238, 4 pages.

* cited by examiner

*Primary Examiner* — Benjamin Fiorello
*Assistant Examiner* — Kyle Armstrong
(74) *Attorney, Agent, or Firm* — Smith Moore Leatherwood LLP

(57) ABSTRACT

Methods and apparatuses are disclosed for the rapid and precise removable installation of a substrate-penetrating device that facilitates underground delivery of various utilities to and/or from devices mounted thereon.

8 Claims, 6 Drawing Sheets

MOUNTABLE EARTH-EMBEDDING ANCHOR WITH REMOVABLE UNDERGROUND CONDUIT PANELS AND INSTALLATION APPARATUS

CROSS-REFERENCE

This application claims the benefit of the priority of presently pending Provisional U.S. Application No. 61/551,435, filed Oct. 26, 2011 entitled Mountable Earth-Embedding Anchor With Removable Underground Conduit Panels And Installation Apparatus, and is incorporated by reference herein in its entirety as if made a part of the present specification.

FIELD OF THE INVENTION

The present disclosure is directed toward the rapid and precise removable installation of a substrate-penetrating device that preferably facilitates the underground delivery of various utilities from devices mounted thereon.

BACKGROUND

Methods and apparatuses that facilitate the installation and removal of various utilities from devices mounted thereon would be very beneficial. Such utilities include, but are not limited to, electricity, water, oil, gases, sewage, other fluids, etc. Currently, in order to install something as simple as an electric lamp post, users must dig a hole, run the underground wire conduit through the hole, and pour concrete into the hole to make a permanent base for the lamp post. This process is tedious, time-consuming and costly in terms of both time and resources. In addition, in the event it is desired to move the utility fixture (e.g. lamp post, etc.) the concrete mooring, being permanent, is not easily removable from the site, and in any event is not reusable. If such mooring must be removed, such removal adds to the overall cost of utility fixture installation (and removal). There have been no useful and accepted advances in this field despite the fact that the presently accepted anchoring methods for utility fixtures are expensive, wasteful and not ecologically sound, as the concrete plug or mooring is most often left behind if a utility fixture is moved to another location, or otherwise no longer in use.

SUMMARY OF THE INVENTION

The present disclosure is directed to a substrate-penetrating device, such as a mountable earth-embedding anchor, with removable underground conduit panels and installation apparatus. The apparatuses and methods of the present disclosure save time, labor, materials, etc., and significantly reduce cost. According to the present disclosure, the methods and apparatuses disclosed herein significantly facilitate changes in location for various fixtures and components that heretofore were deemed permanent. Variations of the present invention described herein allow for the simplified installation, removal and relocation of fixtures such as, for example, lamp posts, signage, and virtually any object that must be firmly implanted into the ground. As stated above, at the present time, according to accepted custom, such objects are placed substantially permanently into the ground, requiring materials, such as, for example concrete, to be used as the permanent mooring. Once implanted into such a mooring, such objects are not easily removed, for example, for reuse in a different location. Indeed, upon removal from their permanent mooring or anchoring such objects are necessarily damaged and cannot be reused. For the purpose of this specification, the terms "substrate-penetrating" and "earth-embedding" may be used interchangeably or in combination.

According to one variation, devices mounted on the presently disclosed mountable earth-embedding anchor with removable underground conduit panels can be connected underground to each other, as well as to similar or different devices, etc. The base plate and removable underground conduit panels of the disclosed mountable earth-embedding anchor with removable underground conduit panels can also accommodate a greater diversity of devices and a larger number of devices substantially simultaneously. Furthermore, the devices presently disclosed require only one individual to operate the devices, and the installation apparatus can be reused for installation of other mountable earth-embedding anchors.

According to one variation, the present invention is directed to a substrate-penetrating device preferably having at least a portion of the device submerged in a substrate comprising at least one removable underground conduit panel that allows passage of materials from underground conduits into the substrate-penetrating or earth-embedding device.

According to a further variation, the present invention relates to a substrate-penetrating, or earth-embedding device comprising an anchor. The anchor preferably comprises a drilling component, and at least one chamber bounded by a housing, with the housing comprising at least one removable panel. According to a variation, the substrate-penetrating earth-embedding device is mountable and comprises an installation head. According to a further variation, the device further comprises an installation apparatus for engaging the installation head, or any part of the device, with the installation apparatus preferably comprising a means for translating and delivering a force, such as a rotational, liner manual or automated mechanical or other direct or indirect force, and combinations thereof, to the anchor. In one variation, the installation head preferably comprises a spirit level. Preferably, the rotational force supplied to the device is a manually-delivered force, and, most preferably, the anchor device is removable and preferably secures a utility fixture in a substrate without a supplemental stabilizer, such as, for example, cement, concrete, etc. The anchor device is manufactured as a single piece, or the anchor may comprise separate pieces that are assembled.

In a further variation, the present disclosure relates to a method for installing and securing a utility fixture that allows passage of materials between mounted devices and underground conduits comprising the steps of providing an anchor device having a first length, with the anchor device comprising a drilling component, at least one chamber with the chamber bounded by a housing and comprising at least one removable panel, and a installation head. The anchor device is oriented to an initial installation position on a substrate surface. Preferably, an installation apparatus is provided and engages the installation apparatus via an anchor device installation head. A force, such as, for example, a rotational force, is provided to the installation apparatus, delivering the anchor device from the initial installation position on a substrate surface to a final installation position whereby a substantial and desired and pre-determined length of the anchor device is directed beneath the substrate surface. A utility fixture to be secured is then provided and secured to the installation head.

BRIEF DESCRIPTION OF THE DRAWINGS

Figure 1:
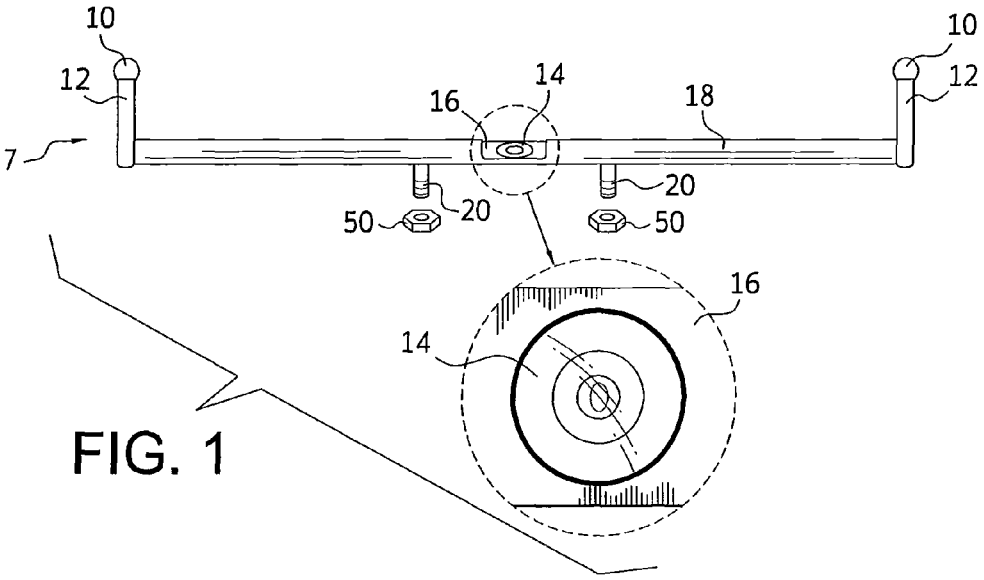
Figure 2:
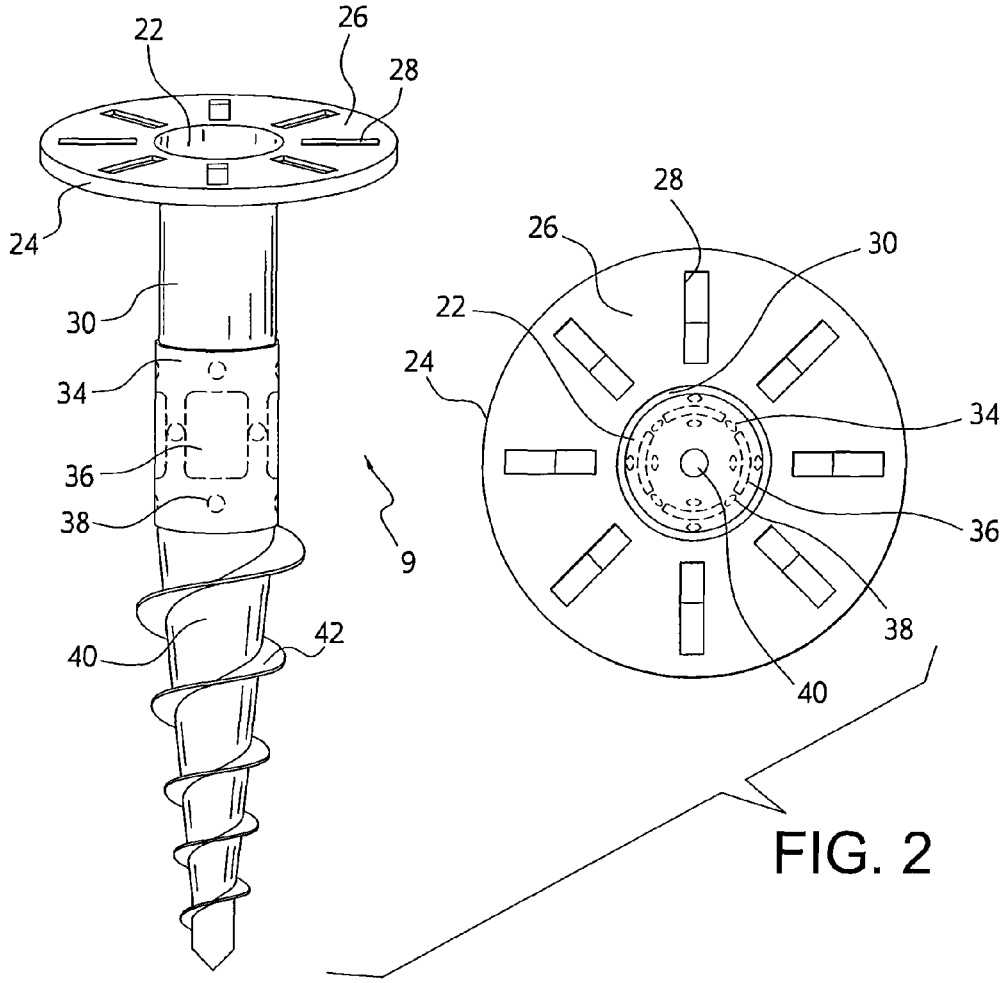
Figure 3:
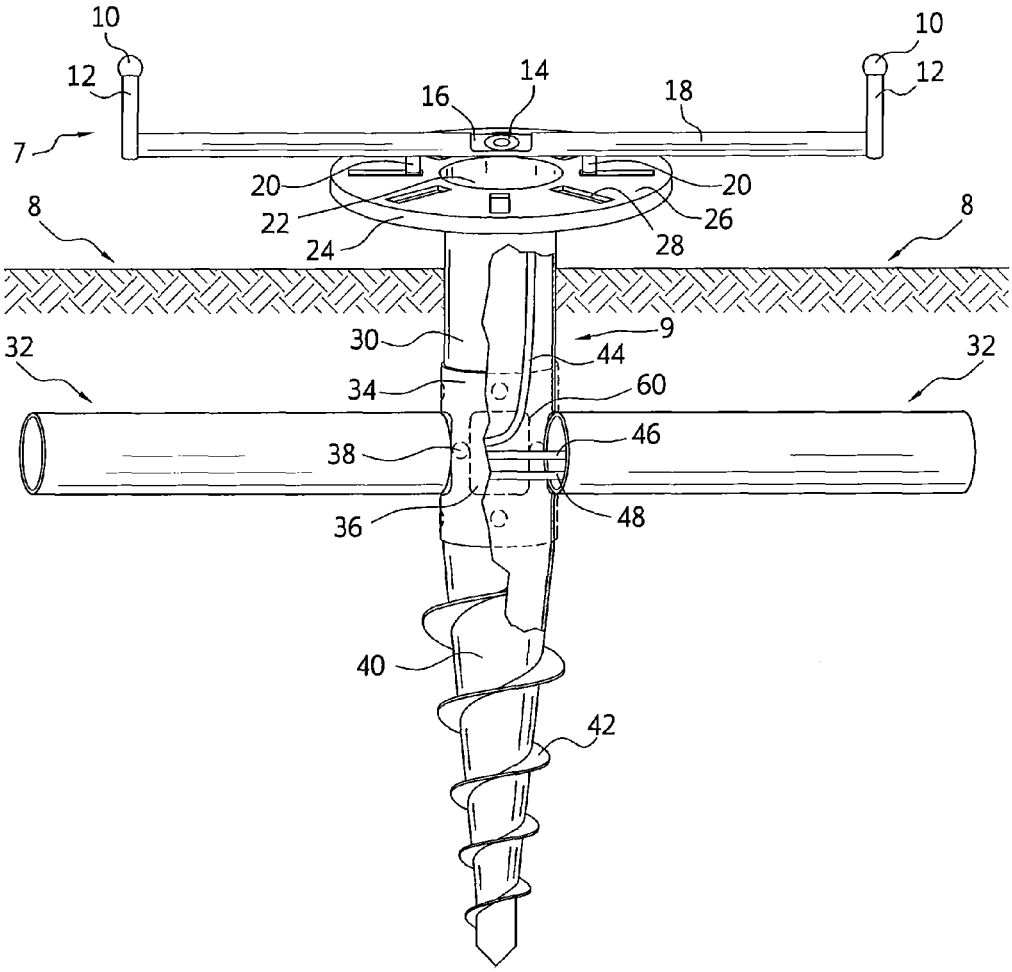
Figure 4:
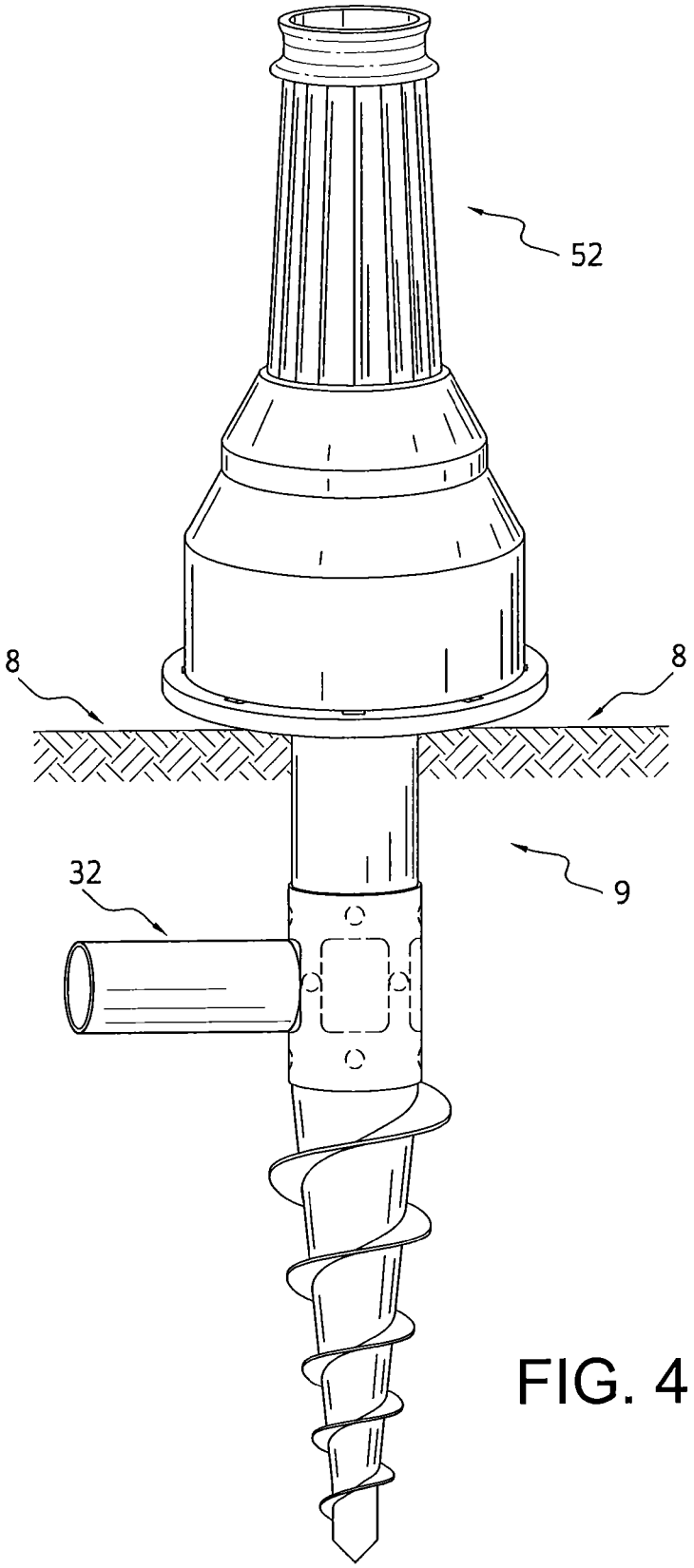
Figure 5A:
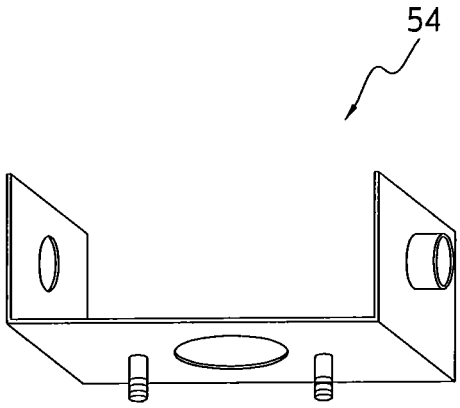
Figure 5B:
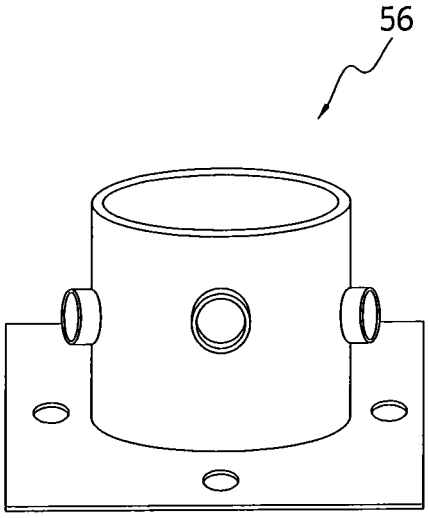
Figure 5C:
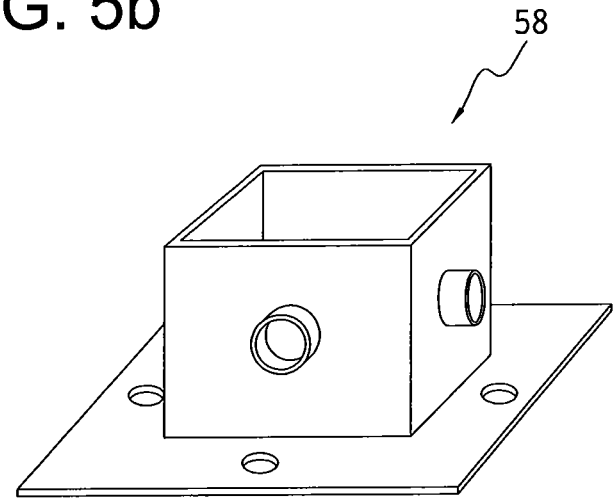
Figure 6:
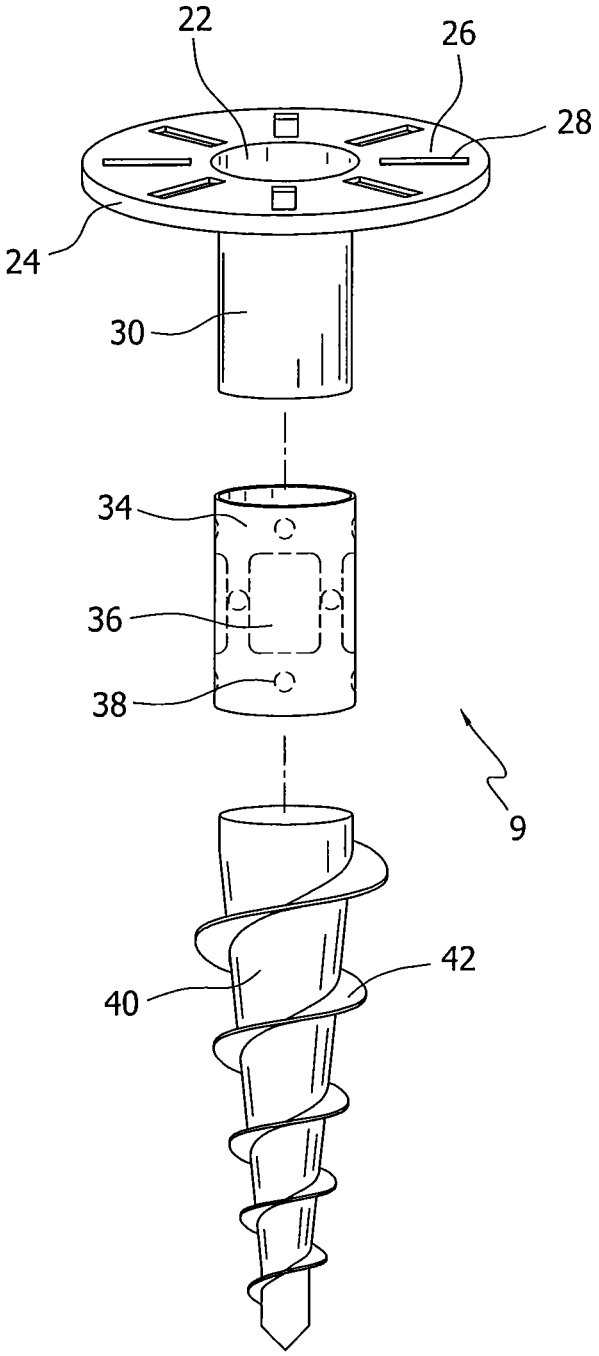
Figure 7:
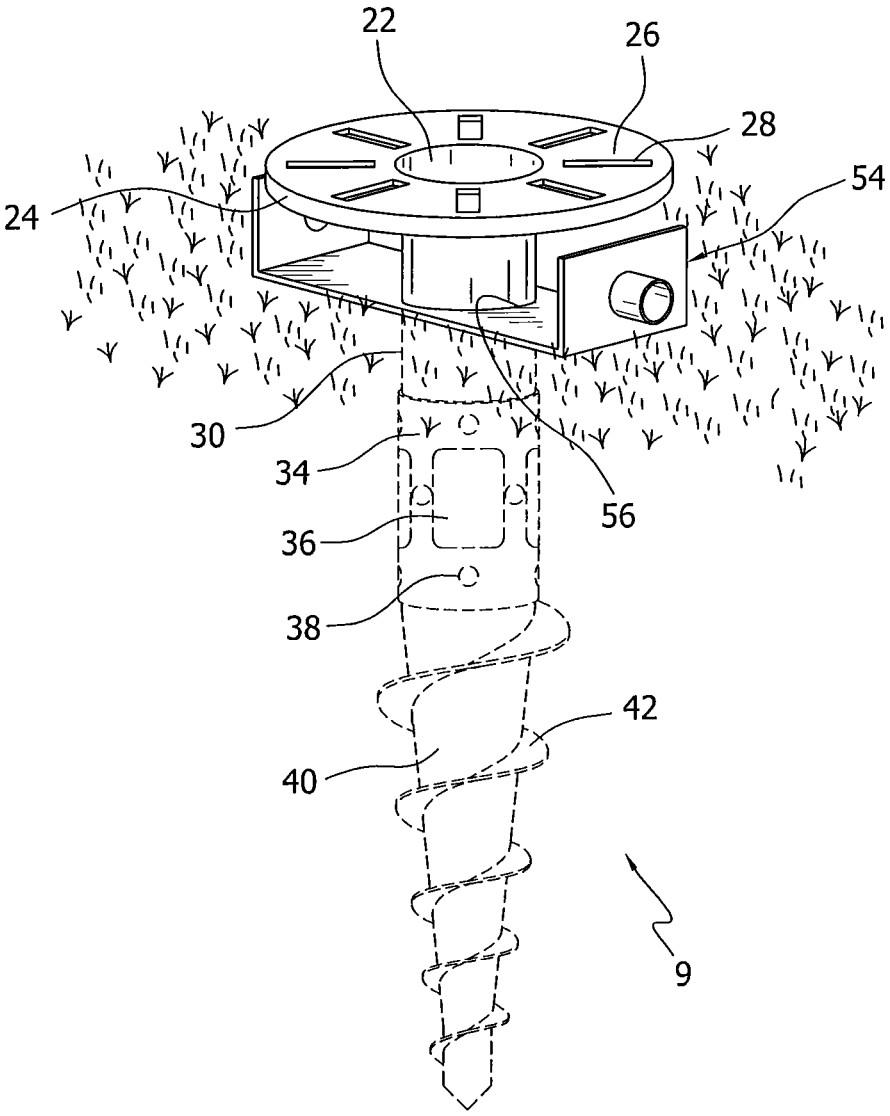

Having thus described variations of the disclosure in general terms, reference will now be made to the accompanying drawings, which are not necessarily drawn to scale, and wherein:

FIG. 1 is a detailed view of the installation apparatus for one variation of the present invention, along with a detailed perspective view of the spirit level;

FIG. 2 is a perspective view and detailed plan view of a variation of the mountable earth-embedding anchor with removable underground conduit panels;

FIG. 3 is a perspective view of a variation of the present invention shown in place in the ground substrate, and showing an underground conduit attached to each side;

FIG. 4 is a perspective view of a variation of the present invention showing the mountable substrate-penetrating earth-embedding anchor with removable underground conduit panels with a fixture base mounted thereto;

FIGS. 5*a-c* show various attachments that can be mounted onto variations of the present invention to secure various devices;

FIG. 6 shows a variation where the mountable substrate-penetrating earth-embedding anchor device can be assembled from multiple pieces into a single unit; and FIG. 7 shows the mountable substrate-penetrating earth-embedding anchor device in position securing an attachment fixture in the ground without the use of separate fasteners.

DETAILED DESCRIPTION

The present invention will be described more fully hereinafter with reference to the accompanying drawings, where preferred alternatives are shown. The disclosures may, however, be embodied in many different forms and should not be construed as limited to the examples or illustrations set forth. Rather, these examples and illustrations are provided so that this disclosure conveys the scope of the inventions provided herein to those skilled in the field. Like numbers refer to like elements throughout.

FIG. 1 shows a preferred, but not limiting, view of an installation apparatus 7 comprising an installation bar 18 with handles 12 at each end. Each handle 12 has a handle tip 10 that is preferably slightly wider at its base than the width of handles 12. Installation bar 18 preferably has a region called the spirit level attachment platform 16 that acts as the attachment site of the spirit level 14. Installation bar protrusions 20 project from installation bar 18 and are preferably dimensioned to engage installation apparatus 7 to mountable substrate-penetrating earth-embedding anchor 9 (shown in FIG. 2), by inserting installation bar protrusions 20 into the elongated insertion sites 28 located on the mountable head 26. Fasteners 50 are preferably placed over a portion of the installation bar protrusions 20 that extend through and past the mountable head 26, preventing dislodgement of installation apparatus 7 from anchor 9. This preferred diagram of installation apparatus 7 shown in FIG. 1 is shown for non-limiting, illustrative purposes only. For example, a simplified installation apparatus is contemplated, whereby such apparatus 7 is a substantially linear rod made from a suitably durable material (e.g. metal, wood, plastic, alloy, composite, etc. or combinations thereof), with the rod passing through openings made in the wall of the anchor 9 or otherwise attaching to anchor 9. In such an example (not shown), rotational motion and torque would be applied to the device by pushing on one side of the rod, while pulling on the other side of the rod to drive the earth-embedding device clockwise or counterclockwise (depending on the desired orientation of the drill threads 42 (see FIG. 2), and downward into and through a substrate surface.

FIG. 2 shows a mountable substrate-penetrating earth-embedding anchor 9 comprising a mountable head 26 with multiple elongated insertion sites 28, a mountable head rim 24, and a cavity opening 22 into the anchor body. According to one embodiment, the depth of the elongated insertion sites 28 is less than the height of the mountable head rim 24. Mountable head rim 24 is preferably a rim extension of mountable head 26 that is integral with the manufacture of the head 26, or that is otherwise attached to head 26, such that the thickness or height of the mountable head rim 24 is greater than the thickness of mountable head 26 alone. One preferred form of mountable head 26 has mountable head rim 24 that is preferably dimensioned to be approximately at least about equal in height to installation bar protrusions 20 in FIG. 1, such that, with the insertion of installation bar protrusion 20 into elongated insertion site 28, the installation bar protrusions 20 do not extend below mountable head rim 24 in a horizontally flat view plane. This orientation is desirable so that the protrusions to not come into contact with the substrate or otherwise impede the implantation of the mountable substrate-penetrating earth-embedding anchor 9. In addition, the dimension of the rim 24 can be selected for the purpose of keeping any bolting assemblies from view when the mountable earth-embedding anchor 9 is in its final installed position. In other variations, where such decorative concerns are not present, the rim may be substantially equivalent to the thickness of the mounting head 26, or any height (thickness) as desired.

The mountable head further comprises cavity opening 22 into the portion of anchor 9 that connects the first portion 30 of anchor 9 to the outside environment above mountable head 26. Therefore, according to one variation shown in FIGS. 1-4, anchor 9 is substantially hollow at least from the area of the mounting head 26 and extending a predetermined distance into the body of anchor 9. First body portion 30 of anchor 9 is connected to, or integral with, a second body portion 34 of anchor 9, such that there is an open path to the outside environment above mountable head 26. Second body portion 34 of anchor 9 preferably comprises a housing that comprises, or is bounded by, at least one perforated removable panel 36 along its walls. Preferably, above and between each of the removable panels 36 are perforated removable anchor sites 38 (all panels and anchor sites not shown). As partially shown in FIGS. 3 and 4, in one variation of the present invention, anchor 9 comprises four removable panels 36 and twelve removable anchor sites 38. A tail section 40 is connected to, or integral with, second body portion 34. The tail section 40 has a first diameter near its point of attachment to second body portion 34 and a second diameter at its end distal from the second body portion 34. This disparity in diameters preferably results in narrowing taper that ends at the tip of anchor 9. Outwardly extending earth-plowing attachments 42, or threads, are affixed to or manufactured integral with the outside of the tail 40 in a spiraling fashion from the portion of tail 40 closest to second body portion 34 of anchor 9, and tapering to a point at the distal end of tail 40 to achieve and facilitate a screw-like or drill effect. This preferred diagram of mountable earth-embedding anchor 9 shown in FIG. 2 is for non-limiting illustrative purposes only.

FIG. 3 shows a perspective view of a mountable substrate-penetrating earth-embedding anchor 9 of the present disclosure in the ground 8 with an installation apparatus 7 attached to anchor 9 via mounting head 26. An underground conduit 32 is shown attached to each side of anchor 9 at the previous locations of two of the removable panels 36. (See FIGS. 2-4). FIG. 3 also shows a partial cut-away view inside anchor 9 and one underground conduit 32. FIG. 3 illustrates how materials from underground conduit 32 can enter and exit mountable earth-embedding anchor 9. FIG. 3, in the cut-away section, shows cables 44, 46, and 48 entering second body portion 34 of anchor 9 through a panel opening 60 effected by the removal of removable panel 36. Cables 44, 46 and 48 extend from and through second body portion 34 and upwardly into first body portion 30 of anchor 9. It is understood that multiple cables may extend from a single conduit 32 into the anchor 9 through a single panel opening, or from multiple conduits 32 into the anchor 9 through multiple panel openings 60. This preferred drawing of one variation of the present invention is for illustrative and non-limiting purposes only.

FIGS. 4 and 5*a-c* show a non-limiting and nonexclusive representation of different types of devices that can be mounted on mountable substrate-penetrating earth-embedding anchor 9 by attaching the base of the devices to the mountable head 26 of anchor 9. For example, decorative mounting base 52, mounting brace 54, round device mounting base 56, and square device mounting base 58 are exemplary and non-exclusive illustrations of mounting bases used, for example, in installation of lamp posts, street lights, water fountains, photovoltaic ground mount systems, benches, mailboxes, etc. These bases can all attach to mountable head 26 by any secure attachment means, such as, for example, screws, bolts, etc. This preferred drawing of mountable earth-embedding anchor 9 with attached decorative mounting base 52, and the other bases shown in FIG. 4 and mounting braces shown in FIGS. 5*a-c* are for non-limiting, illustrative purposes only.

A further variation is shown in FIG. 6 where the mountable substrate-penetrating earth-embedding anchor 9 can comprise multiple pieces that can be assembled before or after installation. For example, tail section 40, itself, can be attached to a manual or automated drive assembly (not shown) for the purpose of driving tail section 40 into a substrate such as, for example, the ground. Once the tail section is driven into place in a given substrate, the body portion 34 can attach to either first portion 30 and then tail section 40, or to tail section 40, and then first section 30. It is understood that according to this variation, the multiple pieces can be joined by any permanent or removable means, such as for example, interlocking features, compression or frictional fit, use of fasteners, pins, bolts, screws and the like, etc., as would be readily understood by one skilled in the field.

FIG. 7 shows the mountable earth-embedding anchor 9 in use for the purpose of anchoring mounting brace 54 into the ground. In this variation, the downward anchoring force of the mountable earth-embedding anchor 9, itself, provides adequate force to secure the mounting brace 54 without the use of additional fasteners, although such fasteners could optionally be used in addition. Though not shown, it is understood that mountable earth-embedding anchor 9 may be driven further into the ground such that the mountable head 26 is substantially in intimate contact with a surface of the mounting brace 54.

By way of example, operation of preferred variations of the present invention will be presented in accordance with the representative installation of an outdoor electrical lamp post at a residence. As shown in FIG. 4, a lamp post has a decorative mounting base 52 with screws, washers, bolts, nuts, etc. (not shown) for anchoring the base 52 to a mountable earth-embedding anchor 9. For this particular task, the user desirably makes an 18 inch trench using a shovel or trencher, etc. Proper wiring is done at the power supply side and placed inside an underground conduit 32 that runs in the trench and stops at the lamp post installation site. The user then places a mountable earth-embedding anchor 9 in the appropriate upright position. For this application, the mountable earth-embedding anchor 9 and installation apparatus is preferably made of hot-dipped galvanized steel, but is understood to be made from any suitably durable material such as, for example, steel, iron, aluminum, other metals, alloys, solid wood or laminate wood, plastics, composite materials, etc., and combinations thereof. Installation apparatus 7 is then placed into position on the anchor 9 with the installation bar protrusions 20 positioned into opposing elongated insertion sites 28 on the mountable head 26. Fasteners 50 are optionally then placed over the portion of the installation bar protrusions 20 that extend outwardly from the other side of mountable head 26 to secure the installation apparatus 7 to mountable earth-embedding anchor 9. For this application, the fasteners 50 are preferably durable rubber bands that fit tightly around installation bar protrusions 20, although any removable securing means may be used as would readily be understood by one skilled in the field.

The mountable earth-embedding anchor 9 and installation apparatus 7 complex is then positioned at the desired location of the lamp post installation. The end of the tail 40 is firmly impaled into the substrate surface manually, such as, for example "by hand". The location of each removable panel 36 relative to the spirit level 14 or handles 12 is noted. Holding each of the two installation apparatus handles 12 with one hand, the user uses the spirit level 14 to insure that the mountable earth-embedding anchor 9 and installation apparatus 7 is substantially perpendicular to the ground. The user then rotates the mountable earth-embedding anchor 9 and installation apparatus 7 in a clockwise direction while applying a downward force sufficient to drive the mountable earth-embedding anchor 9 into the ground.

While the preceding protocol illustrates the manual installation of the mountable earth-embedding anchor 9, it is understood that automated augers, drilling devices, and various other machineries and automations with appropriate attachments may be used to drive the mountable earth-embedding anchor 9 into a final desired position in a substrate.

For one exemplary, non-exclusive, lamp post installation, the mountable earth-embedding anchor 9 has a first body portion 30 that is selectively dimensioned and therefore long enough, such that the removable panels 36 have their lowest portion slightly below 18 inches when the lowest edge of the mountable head rim 24 touches the ground. Some dirt may be removed from the trench until the outside of the second portion of body is visualized. When the mountable head rim 24 is substantially flush with the ground, the user rotates the installation apparatus 7 until one of the removable panels is centered at the opening of the 18 inch deep trench. The user looks at the spirit level 14 to make sure the mountable head 26 is substantially horizontal and then applies upward force on the handles 12 to make certain that the mountable earth-embedding anchor 9 is securely anchored in the substrate. According to one variation, in order to disengage the installation apparatus 7 from the mountable earth-embedding anchor 9, the user plants one or both feet on the edge of mountable head 26 and applies upward force on the handles 12 adequate to disengage the apparatus 7 from the fasteners 50. The handle tips 10 will help prevent a user's hands from slipping off, as the handle tips 10 are preferably slightly wider at their base than the width of handles 12. If the user is still having a difficulty disconnecting installation apparatus 7 from anchor 9, the user can forcibly remove the fasteners from installation bar protrusions 20 prior to exerting the force to remove the installation apparatus from the anchor 9.

The installation apparatus or other device then may be used to disengage the removable panels 36 from the second body portion 34 by extending the apparatus 7 into the cavity opening 22 in anchor 9 and forcibly disengaging the removable panel 36 from the second body portion 34 of anchor 9. After disengaging the perforated removable panel 36 into the inside of second body portion 34, the user passes, for example, cable 44 from the conduit 32 in the trench through the panel opening 60 made by removal of the removable panel 36. The cable 44 is passed from the panel opening 60 through to the cavity 22 opening into first body portion 30 of anchor 9. See FIG. 3. The decorative mounting base 52 is placed over the mountable head 26 and the black cable 44 is pulled therethrough and wired appropriately to the lamp light fixture. The user then secures the decorative mounting base 52 to the mountable head 26 using the already in place hardware (screws, bolts, nuts, etc.). The rest of the lamp post assembly is completed and the user fixes the underground conduit 32 to the panel opening 60. The user fills the trench with dirt and finishes with some minor landscaping.

Different materials, sizes, shapes, and interconnections can be used for all components of mountable earth-embedding anchor 9 and installation apparatus 7. For example, the length, width, depth, height, and thickness of any component of mountable earth-embedding anchor 9 and installation apparatus 7 can vary as desired. Furthermore, different number of components, such as for insertion sites 28 or for removable panels 36, can be used in the manufacture of mountable earth-embedding anchor 9 and installation apparatus 7, as desired.

In addition, the tail portion 40 of the mountable earth-embedding anchor 9 may incorporate earth-plowing features, or screw-like threads 42 oriented to allow for counter-clockwise rotational installation into a substrate (as opposed to the orientation of the threads 42 shown in the FIGS. that allow for clockwise rotational installation). Further, variations of the tail section 40 of the mountable earth-embedding anchor 9 may not incorporate the earth-plowing feature, or screw-like threads 42. For example, the present invention contemplates variations where the mountable earth-embedding anchor 9 may be driven manually or mechanically directly into a substrate to a final installation position with no rotational force applied. In this variation, the tail section 40 may be substantially smooth (without thread-like features), and may incorporate different features and dimension to assist in installation, etc. Therefore it will be understood that the tail section, while shown in the FIGS. as possessing a tapered orientation, may instead be substantially linear throughout its length, with its outer diameter being substantially constant throughout its length. Still further, variations are contemplated where the tail section may or may not be tapered, relative to its width, along its length, but may or may not have its diameter vary along its length along one or more axes, to achieve, for example, a chisel-like cutting edge to assist in its installation, for example, while being forcibly driven into a substrate.

Still further, the present disclosure contemplates a variation where the earth-embedding anchor 9 does not comprise an installation head. In this variation, it is understood that the anchor 9 is driven manually or mechanically into the ground with or without rotation force, such as, for example, via a manual or automated jackhammer, sledgehammer or similar type of device, etc.

It is further understood that, in further variations, different component parts of the earth-embedding anchor 9 may be made from the same or different materials. In other words, depending on the desired use, the earth-embedding anchor 9 may be one integral piece, or may be assembled from multiple piece, and the pieces may be made from the same or different materials, such as, for example, hot-dipped galvanized steel, steel, iron, aluminum, other metals, alloys, solid or laminate wood, plastics, composite materials, etc., and combinations thereof. Still further, if the earth-embedding anchor 9 is being used to secure a fixture that does not require the internal passage of, for example, utility cables, wires, etc., or allow for a fluid flow therethrough, the components may be substantially hollow or substantially solid as desired.

Both the mountable earth-embedding anchor 9 and installation apparatus 7 can be manufactured in any manner, by hand or machine, as one integral piece or in separate components that can be assembled together. For example, the mountable head 26, first body portion 30, second body portion 34, tail 40, and earth-plowing attachments 42 can be manufactured from one piece of metal integrally, and may be machined or molded, etc., or may be assembled as separate pieces of metal that are assembled by any method, such as, for example, welding etc., as would be readily understood by one skilled in the field. In terms of usage, the mountable earth-embedding anchor 9 and installation apparatus 7 are not limited by the examples illustrated in this application. The mountable substrate-penetrating earth-embedding anchor 9 and installation apparatus 7 can be used for mounting devices in earthen surfaces, sandy surfaces, rocky surfaces, wooden surfaces, concrete, plastic, underwater, etc. The mountable earth-embedding anchor can be coated with various materials alone or in combination, such as, for example, silicone, Teflon®, etc., for better handling, performance and ease of installation, etc. Furthermore, two or more bases can be mounted onto mountable head 26, substantially simultaneously. For example, decorative mounting base 52 can be mounted over a previously installed device mounting base 56. This is possible because the elongated insertion sites 28 can be made to accommodate the insertion of two or more screws. Alternatively, the decorative mounting base 52 can be rotated and attached to mountable head 26 using different elongated insertion sites 28. It is understood that this invention is not limited to the variations described above.

It is further understood that, while embodiments of the present invention have been described as employing manual installation, various automated means may be employed for installation. Any high torque motorized or hydraulic means for effecting and transferring rotational force to the present invention to effect the desired installation is contemplated as would be readily understood by one skilled in the field.

While the preferred variations and alternatives of the present disclosure have been illustrated and described, it will be appreciated that various changes and substitutions can be made therein without departing from the spirit and scope of the disclosure. Accordingly, the scope of the disclosure should only be limited by the accompanying claims and equivalents thereof.

What is claimed is:

1. A method for installing and securing a utility fixture that allows passage of materials between mounted devices and underground conduits comprising the steps of:

providing an anchor device comprising: a drilling component; at least one chamber, said chamber bounded by a housing, said housing comprising at least one removable panel and an installation head;

orienting said anchor device to an initial installation position on a substrate surface;

providing an installation apparatus;

engaging the installation apparatus with the anchor device installation head;

providing a force to the installation apparatus to deliver the anchor device from the initial installation position on a substrate surface to a final installation position whereby a substantial length of the anchor device is oriented beneath the substrate surface;

providing an underground conduit to a location proximate to the anchor device, said conduit comprising a material for passage from said conduit into said anchor device;

removing one of the at least one removable panels from the housing to produce an opening into said anchor device after installation of said anchor device;

passing said material from the conduit into said anchor device through the opening in the anchor device housing;

providing a utility fixture to be secured; and securing the utility fixture to the installation head.

2. The method of claim 1, wherein the anchor device is removable.

3. The method of claim 1, wherein the anchor device secures the utility fixture in the substrate without a supplemental stabilizer.

4. The method of claim 1, wherein the force is a rotational force.

5. The method of claim 1, wherein the force delivered to the anchor device is selected from the group consisting of manual force, automated force, and combinations thereof.

6. The method of claim 1, wherein the anchor device is manufactured as a single piece.

7. The method of claim 1, wherein the anchor device comprises separate pieces.

8. The method of claim 1, wherein the installation apparatus comprises a spirit level.

* * * * *